US006886633B2

(12) United States Patent
Fanuel et al.

(10) Patent No.: US 6,886,633 B2
(45) Date of Patent: May 3, 2005

(54) BORE HOLE UNDERREAMER

(75) Inventors: Philipp Fanuel, Brussels (BE); Jean-Pierre Lassoie, Brussels (BE); Stein Erik Moi, Hommersaak (NO); Clint Smith, Cypress, TX (US)

(73) Assignee: Security DBS NV/SA, Drogenbos (BE)

( * ) Notice: Subject to any disclaimer, the term of this patent is extended or adjusted under 35 U.S.C. 154(b) by 0 days.

(21) Appl. No.: 10/264,761

(22) Filed: Oct. 4, 2002

(65) Prior Publication Data

US 2004/0065480 A1 Apr. 8, 2004

(51) Int. Cl.[7] ..... E21B 7/28; E21B 10/32
(52) U.S. Cl. ..... 166/269; 166/271
(58) Field of Search ..... 175/267, 264, 175/271, 291

(56) References Cited

U.S. PATENT DOCUMENTS

| | | | |
|---|---|---|---|
| 336,187 A | 2/1886 | Wells | |
| 1,411,484 A | 4/1922 | Fullilove | |
| 1,485,642 A | 3/1924 | Stone | |
| 1,607,662 A | 11/1926 | Boynton | |

(Continued)

FOREIGN PATENT DOCUMENTS

| | | | |
|---|---|---|---|
| BE | 1012545 A3 | 12/2000 | |
| DE | 28 39 868 | 4/1979 | ..... E21C/23/00 |
| EP | 0086701 | 8/1983 | |
| EP | 0 301 890 | 2/1989 | |
| EP | 0 568 292 A1 | 11/1993 | |
| FR | 569203 | 4/1924 | |
| GB | 0295150 | 8/1928 | |
| GB | 540027 | 10/1941 | |
| GB | 1586163 | 3/1981 | |
| GB | 2 128 657 A | 5/1984 | ..... E21B/10/32 |
| GB | 2 180 570 A | 4/1987 | |
| NL | 8503371 | 7/1987 | ..... E21B/17/00 |
| WO | 00/31371 | 6/2000 | ..... E21B/10/32 |
| WO | 02/072994 A1 | 9/2002 | ..... E21B/10/32 |

OTHER PUBLICATIONS

Notification of Transmittal of International Search Report mailed May 7, 2002 corrresponding to International Application No. PCT/BE02/00031.

UK Search Report for Great Britain Patent Application No.: GB 0323195.8 from Examiner Bob Crowshaw (1 page), Dec. 11, 2003.

International Search Report mailed Jun. 17, 2004 corresponding to International Application No. PCT/BE02/00031, Jun. 17, 2004.

*Primary Examiner*—Hoang Dang
(74) *Attorney, Agent, or Firm*—Baker Botts L.L.P.

(57) ABSTRACT

Provided is a bore hole underreamer, intended in particular for oil drilling. The underreamer has a hollow body and at least two cylindrical bores. The bores are distributed over the circumference of the hollow body and each bore contains a cylindrical widening arm. Each arm has a bladed cutting end disposed on the outside of the body that slides between active and inactive positions. Another end of each arm is disposed inside the body and receives fluid pressure for pushing the arm into the active position. The underreamer includes a locking member for locking the arms in their inactive position when the locking member is immobilized in the body in a releasable fashion in a locking position. When released, the locking member leaves the locking position under a thrust from at least one of the arms subjected to the pressure capable of pushing the arm into its active position.

27 Claims, 3 Drawing Sheets

U.S. PATENT DOCUMENTS

| | | | | | |
|---|---|---|---|---|---|
| 1,631,449 | A | | 6/1927 | Alford | |
| 1,671,474 | A | * | 5/1928 | Jones | 175/269 |
| 1,686,403 | A | | 10/1928 | Boynton | |
| 1,772,710 | A | * | 8/1930 | Denney | 166/55.8 |
| 1,804,850 | A | | 5/1931 | Triplett | |
| 1,878,260 | A | * | 9/1932 | Bunker | 175/269 |
| 2,060,352 | A | | 11/1936 | Stokes | 255/75 |
| 2,169,502 | A | | 8/1939 | Santiago | 255/76 |
| 2,239,996 | A | | 4/1941 | Chappell | 255/74 |
| 2,271,472 | A | | 1/1942 | Balduf | |
| 2,427,052 | A | | 9/1947 | Grant | 255/74 |
| 2,438,673 | A | | 3/1948 | McMahan | 166/18 |
| 2,499,916 | A | * | 3/1950 | Harris | 175/267 |
| 2,710,172 | A | | 6/1955 | Kammerer, Jr. | 175/271 |
| 2,754,089 | A | | 7/1956 | Kammerer, Jr. | 255/76 |
| 2,758,819 | A | | 8/1956 | Kammerer, Jr. | 255/76 |
| 2,809,015 | A | | 10/1957 | Phipps | 255/75 |
| 2,822,150 | A | | 2/1958 | Muse et al. | 255/76 |
| 2,834,578 | A | * | 5/1958 | Carr | 175/237 |
| 2,872,160 | A | | 2/1959 | Barg | 255/76 |
| 2,882,019 | A | * | 4/1959 | Carr et al. | 175/237 |
| 3,105,562 | A | | 10/1963 | Stone et al. | 175/268 |
| 3,180,436 | A | | 4/1965 | Kellner et al. | 175/57 |
| 3,224,507 | A | | 12/1965 | Cordary et al. | 166/55.8 |
| 3,351,144 | A | | 11/1967 | Park | 175/269 |
| 3,365,010 | A | | 1/1968 | Howell et al. | 175/286 |
| 3,425,500 | A | | 2/1969 | Fuchs | 175/269 |
| 3,433,313 | A | | 3/1969 | Brown | 175/270 |
| 3,556,233 | A | | 1/1971 | Gilreath et al. | 175/267 |
| 3,749,184 | A | | 7/1973 | Andeen | 175/18 |
| 3,974,886 | A | | 8/1976 | Blake, Jr. | 175/76 |
| 4,055,226 | A | | 10/1977 | Weber | 175/273 |
| 4,091,883 | A | | 5/1978 | Weber | 175/287 |
| 4,141,421 | A | | 2/1979 | Gardner | 175/263 |
| 4,177,866 | A | | 12/1979 | Mitchell | 175/53 |
| 4,186,810 | A | | 2/1980 | Allan | 175/96 |
| 4,458,761 | A | | 7/1984 | Van Vreeswyk | 166/289 |
| 4,503,919 | A | | 3/1985 | Suied | 175/269 |
| 4,589,504 | A | | 5/1986 | Simpson | 175/267 |
| 4,660,657 | A | | 4/1987 | Furse et al. | 175/269 |
| 4,821,817 | A | | 4/1989 | Cendre et al. | 175/269 |
| 4,842,083 | A | | 6/1989 | Raney | 175/325 |
| 4,889,197 | A | | 12/1989 | Boe | 175/267 |
| 4,915,181 | A | | 4/1990 | Labrosse | 175/263 |
| 5,036,921 | A | | 8/1991 | Pittard et al. | 166/298 |
| 5,060,738 | A | | 10/1991 | Pittard et al. | 175/267 |
| 5,086,852 | A | | 2/1992 | van Buskirk | 175/269 |
| 5,139,098 | A | | 8/1992 | Blake | 175/269 |
| 5,255,741 | A | | 10/1993 | Alexander | 166/278 |
| 5,265,684 | A | | 11/1993 | Rosenhauch | 175/61 |
| 5,271,472 | A | | 12/1993 | Leturno | 175/107 |
| 5,318,137 | A | | 6/1994 | Johnson et al. | 175/40 |
| 5,318,138 | A | | 6/1994 | Dewey et al. | 175/74 |
| 5,330,016 | A | | 7/1994 | Paske et al. | 175/320 |
| 5,332,048 | A | | 7/1994 | Underwood et al. | 175/26 |
| 5,348,095 | A | | 9/1994 | Worrall et al. | 166/380 |
| 5,368,114 | A | | 11/1994 | Tandberg et al. | 175/267 |
| 5,560,440 | A | | 10/1996 | Tibbitts | 175/384 |
| 5,590,724 | A | | 1/1997 | Verdgikovsky, deceased | 175/57 |
| 5,655,609 | A | | 8/1997 | Brown et al. | 175/76 |
| 5,957,222 | A | | 9/1999 | Webb et al. | 175/45 |
| 5,957,226 | A | | 9/1999 | Holte | 175/320 |
| 6,059,051 | A | | 5/2000 | Jewkes et al. | 175/76 |
| 6,070,677 | A | | 6/2000 | Johnston, Jr. | 175/57 |
| 6,131,675 | A | | 10/2000 | Anderson | 175/268 |
| 6,189,631 | B1 | | 2/2001 | Sheshtawy | 175/284 |
| 6,209,665 | B1 | | 4/2001 | Holte | 175/273 |
| 6,244,664 | B1 | | 6/2001 | Ebner et al. | 299/80.1 |
| 6,269,893 | B1 | | 8/2001 | Beaton et al. | 175/391 |
| 6,289,999 | B1 | | 9/2001 | Dewey et al. | 175/38 |
| 6,360,831 | B1 | | 3/2002 | Åkesson et al. | 175/269 |
| 6,378,632 | B1 | | 4/2002 | Dewey et al. | 175/269 |
| 6,419,025 | B1 | | 7/2002 | Lohbeck et al. | 166/380 |
| 6,464,024 | B2 | | 10/2002 | Beaton et al. | 175/391 |
| 2003/0079913 | A1 | | 5/2003 | Eppink et al. | 175/61 |

* cited by examiner

BORE HOLE UNDERREAMER

TECHNICAL FIELD

The present invention concerns an underreamer for a bore hole in a terrestrial formation, intended in particular for oil drilling.

BACKGROUND

The known underreamer has a hollow body, with a longitudinal axis, which has an external wall and which is arranged so that a pressurised drilling fluid can pass through it. At least two cylindrical bores are provided through the internal wall and their axes are transverse to the aforementioned longitudinal axis, the bores being distributed on the periphery of the hollow body. In each of the bores, there is mounted a cylindrical enlarging arm which has a cutting end, disposed on the external side of the hollow body and provided with blades for enlarging the hole. The active cutting elements deployed on the cutting end of the arms may be comprised of Polycrystalline Diamond Compacts (PDCs), rolling cutters, natural diamond cutting elements, carbide inserts, or impregnated diamond elements, or any combination thereof. Essentially any hard and abrasion resistant material known in the art can be deployed on the arms to accomplish the cutting activity as dictated by the composition of the rock to be drilled.

Each arm is arranged in the bore like a hydraulic piston, so as to be able to slide therein in the direction of its axis between an active position in which this cutting end is distant from the hollow body, in order to effect an enlarging of the hole, and an inactive position at least close to, or flush with, the external periphery of the hollow body or retracted therein. The other end of the arm, inside the hollow body, is intended to receive from a drilling fluid, circulating in the hollow body, a pressure capable of pushing the said arm into its active position. An underreamer of this type is known through the document BE-1 012 545.

In this known underreamer, before it is brought into service on each occasion, each arm may be locked distinctly in the inactive position. This is because the arms cannot be deployed unintentionally following variations in the pressure of the fluid passing through the underreamer, except as from a time chosen by the operator. In particular therefore, for each new use of the known underreamer, a new locking pin may be easily installed at the field location, in order to renew the distinct locking means.

Thus there is amongst other things a need to be able to easily reestablish this locking of the arms in a sure fashion each time the underreamer is sent into the bore hole.

In addition, this type of equipment is subjected to very harsh forces under working conditions which are known to be very difficult and therefore very expensive. Firstly, an equipment breakdown may cost enormous sums in time lost in attempting to save the equipment, for example jammed at a great depth, and in particular saving the bore hole made at great expense and which, otherwise, could be definitively condemned. Secondly, when the equipment is recovered, an equipment breakdown must be able to be repaired very easily because the technical repair means available on or close to a drilling platform are limited.

Accordingly, it is desired to procure an underreamer of simple design and reliable operation, whose arms can be locked easily and rapidly in the inactive position, and therefore without significant dismantling, and which is composed of a reduced number of parts assembled robustly, easily and rapidly dismantled and exchanged when needed.

SUMMARY

To this end, according to the invention, the underreamer has, for the underreaming arms, a common locking member

- which can occupy a locking position in which this member locks the arms in their inactive position,
- which is immobilised in the hollow body, in a releasable manner, in the locking position, in particular before use of the underreamer, and
- which, when it is released, can leave the said locking position under a thrust of at least one of the arms subjected to the pressure capable of pushing the said arm into its active position.

According to one embodiment of the invention, the locking member is fixed to the hollow body in the said releasable manner, by a breakable pin calibrated for this purpose in accordance with a single given pressure of the fluid. Preferably the hollow body has, in order to receive the breakable pin, a housing opening out on the external periphery of the said body.

Advantageously, the locking member is arranged so as to slide axially in the hollow body, from its locking position, under the thrust of the arms, and has, seen along its axis and on the side of the arms, an end face which cooperates with a support face for each arm for locking it.

According to one advantageous embodiment, the underreamer of the invention has a common prestressed spring system arranged so as to return the arms to the inactive position when the pressure of the fluid is below a given value. The spring system advantageously acts on the arms by means of the locking member in order to return these to the inactive position.

According to a particular embodiment of the invention, a tool is provided, arranged to bear on the said body and to move the spring system away from the arms, in particular by means of and with the locking member.

Preferably, a choice is made of the inside and outside diameters of the hollow body, of an axial length of the arms and of their shape so that the complete arms can be installed in their respective bores whilst passing through the inside of the hollow body. In particular, there is provided for this purpose, in one end of the body, on the downstream side following the direction of drilling and a direction of flow of the fluid in the body, a threaded hole with a diameter greater than the diameter of an external thread at the end of the body on the upstream side. There can then be provided an adaptation piece with a male thread, for this threaded hole with a greater diameter, and with a female thread, matching the said external thread, in order to receive a normal bit.

According to one particularly advantageous embodiment, the underreamer of the invention has an internal piece removably fixed in the hollow body, downstream of the arms, and having, on the side turned towards the arms, for each of these, a guidance groove with two parallel sides parallel to the longitudinal axis, the sides being arranged to cooperate with two parallel edges carried by each of the arms, in order to prevent rotation thereof around their axes. The groove has a length, width and depth corresponding to the two edges and to a travel which they make between the active and inactive positions of the associated arm.

The internal piece may be fitted with a sleeve or other spacing means to control the maximum opening distance of the arms. In this way the user can adjust the enlargement diameter to meet the bore hole requirements. In an alternative embodiment the sleeve can be deployed in the internal diameter of the tool body to limit the travel of the piston lugs, thereby adjusting the maximum opening distance of the arms.

Other details and particularities of the invention will emerge from the secondary claims and from the description of the drawings which accompany the present document and which illustrate, by way of non-limiting examples, particular embodiments of the underreamer according to the invention.

BRIEF DESCRIPTION OF THE DRAWINGS

In the various figures, which are sections drawn by computer, the same reference notations designate identical or similar elements.

DETAILED DESCRIPTION

Figure 1:
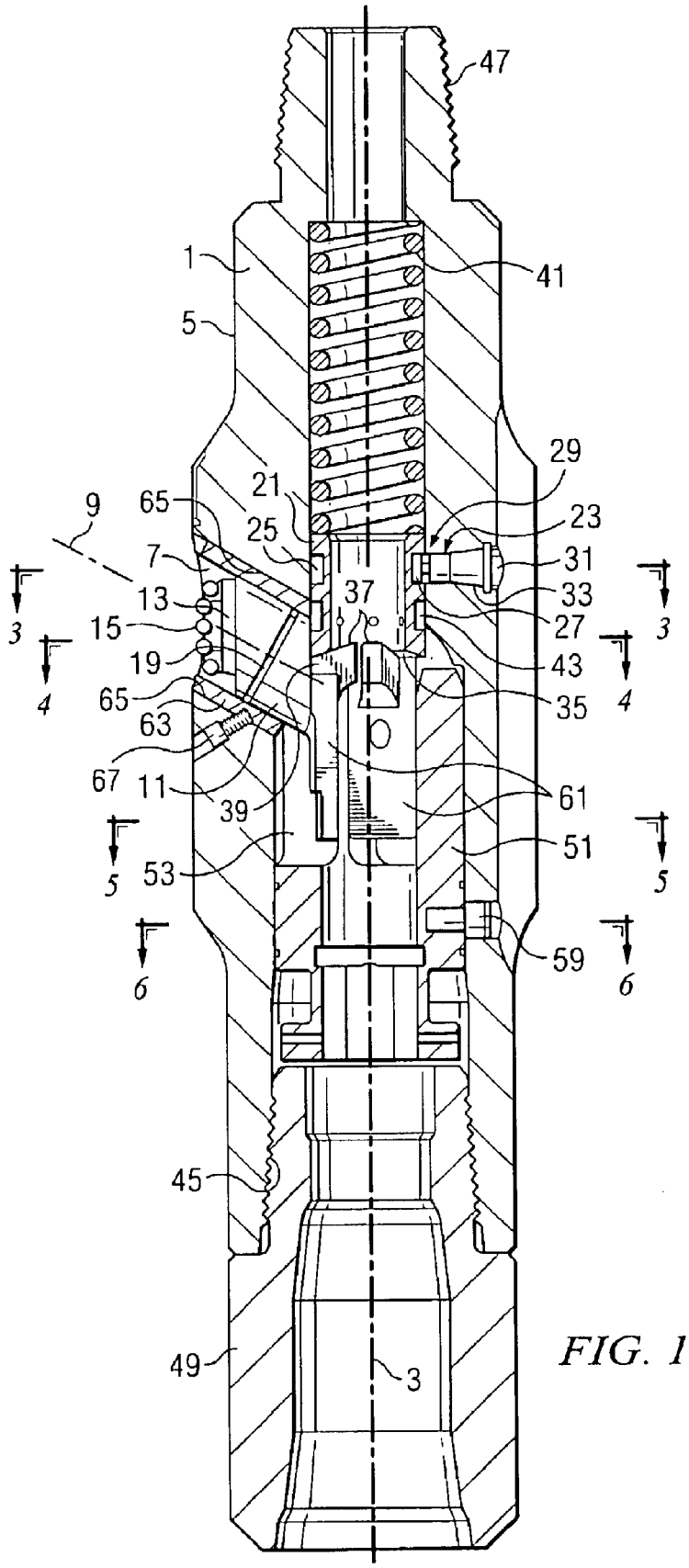
FIG. 1 is a schematic view in elevation and axial section of an underreamer according to the invention, in which the arms are in the inactive position.

The underreamer of the invention (FIGS. 1 and 2) has a hollow body 1, with a longitudinal axis 3, which has an external wall 5 and which is arranged so that a pressurised drilling fluid can pass through it. At least two cylindrical bores 7 are provided through the external wall 5 and their axes 9 are transverse to the aforementioned longitudinal axis 3. The bores 7 are distributed over the circumference of the hollow body 1, usually at angular distances which are equal to each other over the circumference but, if the circumstances so justify, these angular distances may be unequal. In addition, in the various figures (in particular in the transverse sections) the various arms 11 are shown as being situated longitudinally at the same level in the body. This is obviously an arrangement which is normally implemented but the invention is not limited to this and arms 11 at different levels are also envisaged.

Figure 2:
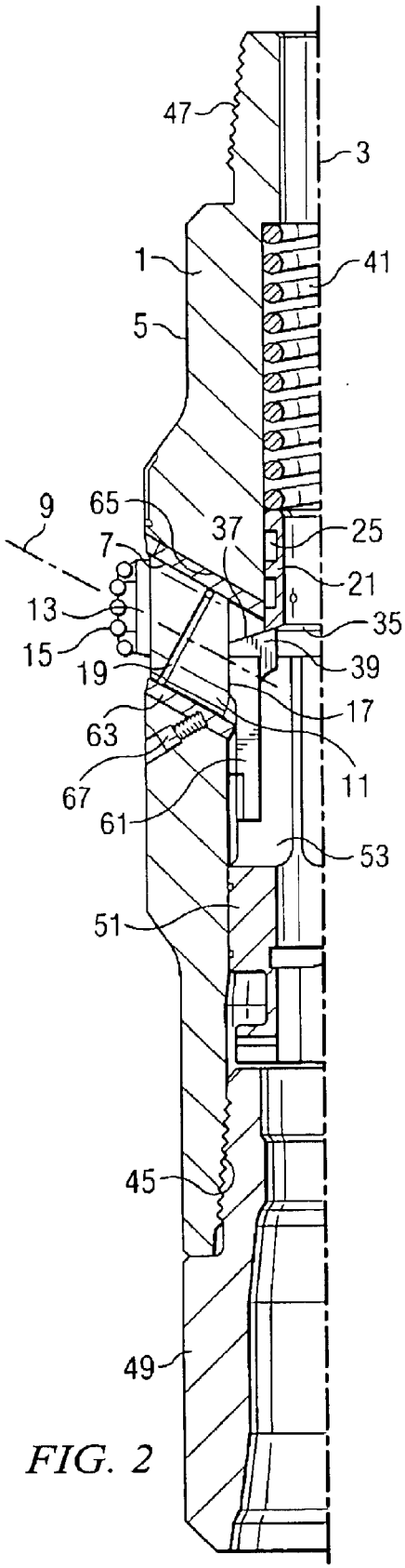
FIG. 2 is a schematic half-view in elevation and section of the same underreamer in which the arms are in the active position.

In each of the bores 7, there is mounted a cylindrical widening arm 11 having a cutting end 13 disposed on the external side of the hollow body 1 and provided with blades 15 for enlarging the bore hole. Each arm 11 is arranged in the bore 7 like a hydraulic piston, so as to be able to slide therein in the direction of its axis 9, common to that of the bore 7, between an active position (FIG. 2) in which this cutting end 3 is distant from the hollow body 1, in order to effect an enlarging of the hole, and an inactive position (FIGS. 1 and 4) at least close to, or flush with, the external periphery of the hollow body 1 or retracted therein. The other end 17 of the arm 11, inside the hollow body 1, is intended to receive from a drilling fluid, in circulation in the hollow body 1, a pressure capable of pushing the said arm into its active position in FIG. 2. FIGS. 1 and 2 show for this purpose that each arm 11 is provided with a circular peripheral groove 19 intended to receive a sealing joint. The said joint could however be disposed in a groove cut in the wall of the bore 9. In either case of a groove for a joint between the arm 11 and the bore 7, this groove can be cut in a plane perpendicular to each common axis 9, as shown in FIGS. 1 and 2. The said groove could however be cut in a plane which would be perpendicular to a plane comprising the longitudinal axis 3 and the common axis 9 and which would at the same time be parallel to the aforementioned longitudinal axis 3, an ellipsoidal joint being able to be designed for this purpose. As the different sections in FIGS. 3 to 6 show, three arms 11 at the same level in the body 1 of the underreamer can easily be provided.

According to the invention, the underreamer has, for locking the widening arms 11 in the inactive position, a locking member 21 common to all the arms 11.

This common locking member 21 is arranged so as to occupy a locking position (FIG. 1) in which it locks the arms 11 in their inactive position. It is designed to be immobilised in the hollow body 1, in a releasable manner, in the said locking position, principally before use of the underreamer. When it is released, the locking member 21 can leave the said locking position under a thrust of at least one of the arms 11 subjected to the pressure capable of pushing the said arm 11 into its active position (FIG. 2).

To keep the locking member 21 as mentioned releasably in its locking position, it can be fixed to the hollow body 1 (FIGS. 1 and 3) by a breakable pin 23, preferably only one, calibrated for this purpose in accordance with the said given fluid pressure threshold. This type of calibration is known per se to persons skilled in the art.

Figure 3:
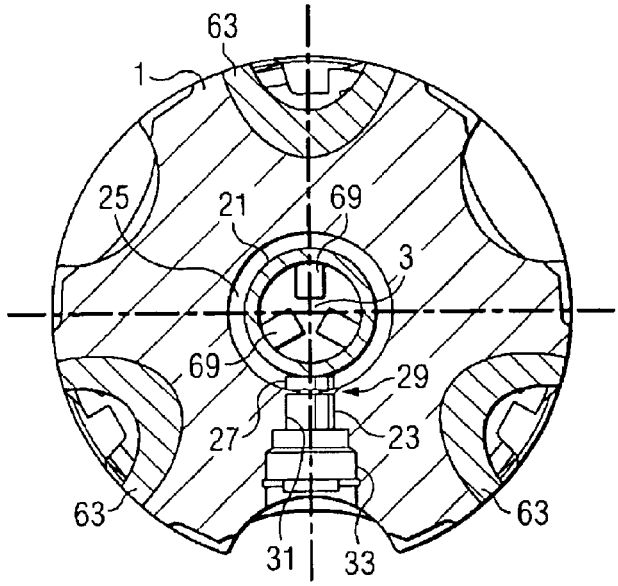
FIGS. 3 to 6 are, in each case, to another scale, a transverse section respectively along the plane III—III, the plane IV—IV, the plane V—V and the plane VI—VI in FIG. 1.

As shown by FIGS. 1, 2 and 3, a circular groove 25 is fashioned in the locking member 21 so as to entirely receive one end 27 of the breakable pin 23. This end 27 is connected to the remainder of the breakable pin 23 by means of an area with a reduced cross-section 29 formed so as to obtain the aforementioned calibration. The said remainder of the pin 23 is fitted in the hollow body 1. Preferably the latter has, for receiving the breakable pin 23, a housing 31 opening out on the external periphery of the said body 1, and closed for example by a plug 23 to be screwed or fixed by any other appropriate means.

Any unlocking movement of and by the locking member 21 can be envisaged. It appears however advantageous for this member 21 to be arranged so as to slide axially in the hollow body 1, from its locking position, under the thrust of the arms 11 and for it to have, seen along its axis and on the side of the arms 11, an end face 35 which cooperates with a support face 37 of each arm 11 for the locking thereof.

The direction in which the arms 11 move can be any direction. However, it is preferred for the axis 9 of the arms 11 to intersect the longitudinal axis 3 of the hollow body 1 and, starting from this longitudinal axis 3, for it to be perpendicular thereto or rather inclined in the direction of a drill string (not shown) fixed upstream, in a direction S of drilling travel or flow of drilling fluid in the body 1. The locking member 21 is then situated upstream of the arms 11 and slides upstream in order to release these.

The inclination of the arms 11 towards the string, around 60 degrees at least with respect to the longitudinal axis 3, procures, with respect to a perpendicular direction between the axes 9 and 3, a surface of the cutting end 13 which is greater and therefore more space for blades 15 and/or diamonds and/or other cutting elements.

In a variant, the said end face 35 of the locking member 21 can have, for each arm 11, a frustoconical support surface hollowed in the locking member 21 and determined by a rectilinear generatrix. The latter, starting from the periphery of the locking member 21 and returning to this, intersects the longitudinal axis 3 at an acute angle of for example 75 degrees. From this position, this generatrix can be moved in rotation about the longitudinal axis 3.

This angle of 75 degrees, or a close value, proves beneficial for helping to return the arms 11 to their inactive position as explained below.

In another variant, not shown, the said generatrix which forms the support surface can be moved parallel to itself in a plane perpendicular to the plane which it forms with the longitudinal axis 3, so as therefore to form on each occasion a flat support surface. In the case of this other variant, it is necessary to prevent, by normal means, a rotation of the locking member 21 about the longitudinal axis 3.

In either variant, the support face 37 of each arm 11 is fashioned on a projection 39 thereon so as to present, in the mounted state of the arm 11 in the hollow body 1, a complementary shape and an inclination identical to those of the support surface of the end face 35 of the locking member 21.

To prevent a rotation of an arm 11 about its axis 9, and thereby wrong orientation of the cutting elements 15 which it carries at its cutting end 13, there exist various means.

For this purpose, provision can in particular be made, especially in the context of the said other variant above (not shown), for the aforementioned projection 39 of each arm 11 to have two lateral faces (not shown) which are parallel to each other and to a plane formed by the common axis 9 and the longitudinal axis 3. These lateral faces extend between the said support face 37 and the remainder of the arm 11 over a length corresponding to the relative movements between the locking member 21 and each arm 11. Then, on each side of the said corresponding support surface of the locking member 21, there are provided on the latter two parallel guidance faces arranged in the same way to cooperate with the said two lateral faces of the projection 39. An arrangement of this type simultaneously prevents rotation of the locking member 21 about the axis 3.

The underreamer according to the invention preferably has a common prestressed spring system 41, in particular a compression spring 41, arranged to bear on the hollow body 1 in order to return the arms 11 to the inactive position. As can be seen in FIGS. 1 and 2, this spring system 41 advantageously acts on the arms 11 by means of the locking member 21 in order to return them to the inactive position.

A person skilled in the art understands that the force deployed by such a spring 41, around 825 kilos because of the space available for a particular model of underreamer, is relatively small compared with that produced by a pressure of the fluid, for example around 50 to 100 bars, which for this model gives an order of magnitude of 1.4 to 2.8 tonnes on each arm 11.

To put the aforementioned underreamer, lowered into the bore hole, into action at the required time, the operator increases, up to the said threshold, or beyond, the pressure of the fluid in the string which carries this underreamer. The fluid at this pressure acts on the said other ends 17 of the arms 11 by means of which it produces a force which each arm 11 then applies to the locking member 21. The latter acts on the breakable pin 23 calibrated so as to break, at the point of the reduced area 29, as from a force corresponding to the said pressure threshold. The detached end 27 of the pin 23 remains in the circular groove 25 whilst the remainder of this pin 23 remains entirely in the housing 31. The locking member 21 thus released releases the arms 11 which, under the pressure of the fluid, execute a piston movement and their cutting ends 13 can go to the active position as they cut into the formation around.

When the pressure of the fluid in the hollow body is sufficiently reduced, the spring system 41 pushes the locking member 21 which, through its end face 35, pushes on the support faces 37 of the arms 11 and thus returns these to the inactive position. If then the underreamer is taken up again, it is possible to remove from the said housing 31 the part of the breakable pin 25 which is situated therein and to introduce therein a new complete pin 23, the end 27 of the broken pin being able to remain stored in the circular groove 25, without interfering, until dismantling is required either for maintenance or for repair of the underreamer, or because the circular groove 25 contains too many ends of this type.

It is also clear from an examination of FIGS. 1 and 2 that, when the pressure of the fluid pushes the arms 11 into the active position and therefore these push the locking member 21 and compress the spring 41, one or two of the arms 11 can hold the spring 41 completely or partially compressed whilst the other one or others, subjected for example to a reaction from the formation, may return inside the body 1 whilst having to overcome only the said pressure: there is not in the underreamer of the invention a rigid connection between the arms 11, obliging them to be irremediably in the active position altogether in the event of an excessive force on one of them. Persons skilled in the art know and understand themselves the advantages of this mounting and will thus find that an arm 11 with too much force on it can retract before being damaged, if the operator complies with a maximum applied pressure.

Given the particular arrangement of the locking member 21 and of the spring 41, there can easily be provided a tool (not shown) arranged to bear on the said body 1 and to move the arms 11 away from the spring system 41, in particular by means of and with the locking member 21. This tool can, according to its design, be introduced to one or other end of the underreamer and, according to circumstances, pull or push on the locking member 21 in order to compress the spring 41.

It is possible easily to provide in addition a removable stop means (also not shown) which is arranged to temporarily hold the spring system 41 away from the arms 11, in particular by means of the locking member 21. This removable stop means can consist of a suitable rod which is introduced into the aforementioned housing 31, in place of the breakable pin 23, when a second circular groove 43 fashioned on the locking member 21 is positioned, in particular by means of the aforementioned tool, facing the said housing 31.

The underreamer according to the invention is particularised compared with those known from the state of the art by a choice of the inside and outside diameters of the hollow body 1, of an axial length of the arms 11 and of their shape enabling the complete arms 11 to be installed in their respective bores 7 by passing through the inside of the hollow body 1. In particular, there is provided for this purpose in one end of the body 1, preferably on the downstream side because of the arrangement of the constituent parts, a threaded hole 1 with a diameter greater than the diameter of the external thread 47 at the end of the body 1 on the upstream side. It is then possible to provide an adaptation piece 49 with a male thread for this threaded hole 45 and with a female thread matching the said external thread 47, for connecting a bit to the underreamer in the usual manner for example.

It is however possible to fix directly, without the adaptation piece 49, in the threaded hole 45 with a greater diameter, a drilling bit whose end with a male thread is chosen accordingly. For this purpose, this threaded hole 45 preferably has a dimension which is standard in the industry, or the male thread on the bit is adapted to the threaded hole 45.

Figure 6:
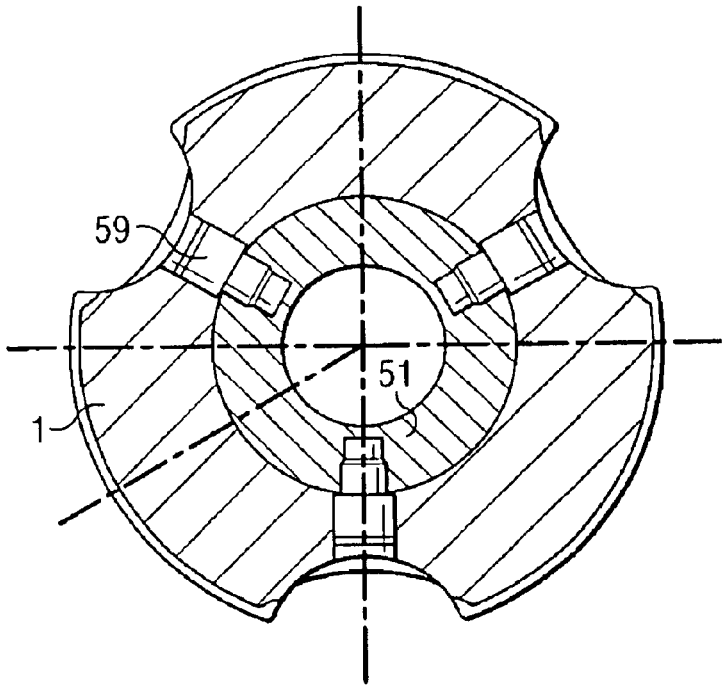

As shown in FIGS. 1, 2 and 6, the underreamer of the invention can have an internal piece 51 removably fixed in the hollow body 1, downstream of the arms 11, and having, on the side turned towards the arms 11, for each of these, a guidance groove 53 (FIGS. 1, 2 and 5) with two sides 55 preferably parallel, parallel to the longitudinal axis 3. The sides 55 are arranged to cooperate with two parallel edges 57 carried by each of the arms 11, in order to prevent rotation thereof about their axes 9. The dimensions of these sides 55 and edges 57 are chosen according in particular to the travel of the arms 11 between the active and inactive positions. The internal piece 51 is held in the body 1 for example by three pegs 59 (FIGS. 1 and 6).

The two parallel edges 57 carried by an arm 11 can be fashioned on a lug 61 (FIGS. 1, 2 and 5) which the said arm has and which extends downstream, parallel to the longitudinal axis 3.

Figure 4:
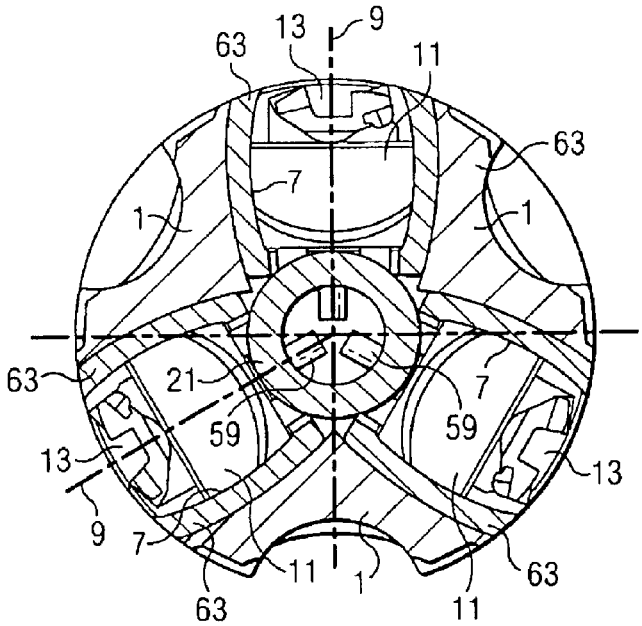
Figure 5:
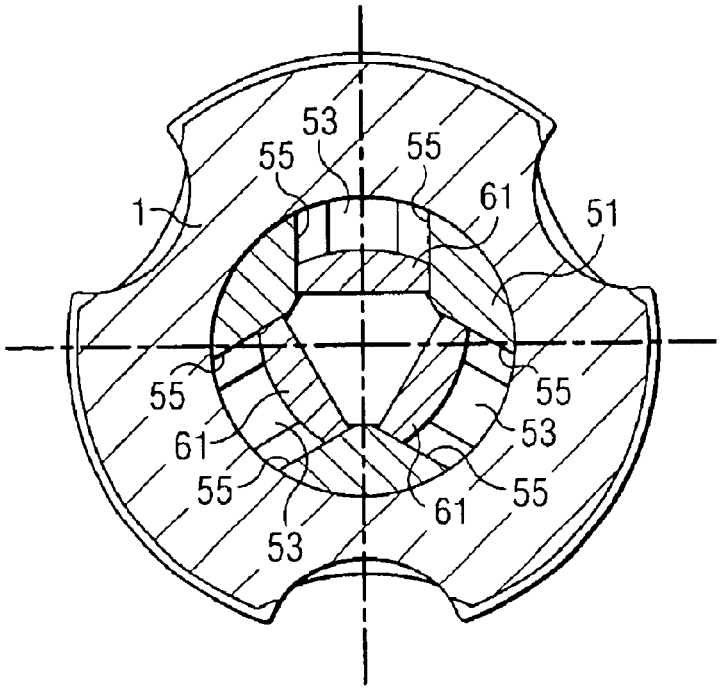

As shown in FIGS. 1, 2 and 4, each of the bores 7 is fashioned in a sleeve 63 (FIGS. 1, 2 and 4) made from high-strength metal (toughened steel etc), adhesively bonded in a housing 65 fashioned in the hollow body 1. A temporary or permanent fixing screw 67 can however also be used simultaneously.

Advantageously, the arms 11 can each have at their internal end 17 a protrusion 69 (FIGS. 1, 2, 3 and 4). These protrusions 69 are arranged so as to partially close off, in the inactive position of the arms 11, the passage of the fluid in the body 1 and thus to produce a detectable pressure difference in the fluid compared with that which is established when the arms 11 are in the active position. This can be used as a signal for indicating to the operator the position of the arms 11.

The protrusions 69 can in fact be combined with the aforementioned projections 39, in order to constitute only one element on each arm 11.

It must be understood that the invention is in no way limited to the embodiments described and that many modifications can be made to the latter without departing from the scope of the claims.

Thus the underreamer of the invention can have, downstream of the arms 11, a valve seat (not shown) intended to receive a ball, for example launched via the drill string, in order to reduce at a chosen moment the cross-section of the passage available for the fluid and thus to increase the pressure of the fluid on the arms 11, in particular to hold them in the active position during widening whilst moving upstream.

In this context, it will be noted that the orientation of the arms 11 pointing substantially upstream (FIGS. 1 and 2) is favourable to a natural thrust of the formation of the arms 11, during the raising of the underreamer without fluid pressure, and helps them to retract into the body 1 should something prevent them from this.

It is noted that there is no deployment of "Weight on Bit" (WOB) while initially deploying the arms 11. The pressure is increased to push the arms 11 out and the string is rotated to allow the arms 11 to begin to cut the enlarged diameter hole. This continues for a predetermined length of time (e.g., about 5 minutes) or until there is a reasonable expectation that the full diameter of enlargement has been achieved. Weight is then added, at which point the cutting profile of the cutting structure will act to keep the tool stabilized and the arms 11 deployed while in engagement with the formation. Accordingly, at the time of deployment, the said orientation of the arms 11 pointing substantially upstream is also favourable to their emergence from the body 1 in order to adopt their active position since a force component in this direction occurs, along the axis 9, because of the WOB.

In the preferred embodiment the cutting structure deployed on the arms has an upwardly curving profile at a point near the outer diameter of the diameter of the body. Thus the pattern of the formation cut tends to stabilize the tool while in use and additionally tends to utilize the WOB to keep the arms of the tool deployed while the tool is actively engaged in cutting formation.

In a variant again, the underreamer of the invention can have an electrical activator (not shown but known) preferably disposed between the underreamer and the string fixed upstream in order to carry the underreamer. This electrical activator, which is remote controlled by the operator, is equipped with a control tube which is introduced into the underreamer and which can occupy on command a position in which it immobilises the locking member 21 in its own locking position and a position retracted from the locking member 21 so that the latter allows the arms 11 to slide as far as their active position. According to the requirement of the operator, this activator can be used in combination with the breakable pin 23 or even without it.

| Legend to the figures | |
|---|---|
| S | direction of drilling/of fluid |
| 1 | hollow body |
| 3 | longitudinal axis of 1 |
| 5 | external wall of 1 |
| 7 | cylindrical bores in 1 |
| 9 | axes of 7 and 11 |
| 11 | widening arm |
| 13 | cutting end of 11 |
| 15 | blades/cutting elements of 13 |
| 17 | other, or internal, end of 11 |
| 19 | peripheral groove for joint between 7 and 11 |
| 21 | locking member 11 |
| 23 | breakable pin for 21 |
| 25 | circular groove in 21 |
| 27 | end of 23 |
| 29 | area of reduced cross-section |
| 31 | housing of 23 in 1 |
| 33 | plug of 31 |
| 35 | one end face of 21 |
| 37 | one support face of 11 cooperating with 35 |
| 39 | projection on 11 |
| 41 | spring system or (compression) spring |
| 43 | circular groove in 21 |
| 45 | threaded hole in 1 |
| 47 | external thread on 1 |
| 49 | adaptation piece |
| 51 | internal piece |
| 53 | guidance groove in 51 |
| 55 | sides of 53 |
| 57 | parallel edges of 11 |
| 59 | pegs of 51 |
| 61 | lug of 11 |
| 63 | sleeve |
| 65 | housing of 63 in 1 |
| 67 | screw for 63 |
| 69 | protrusion on 11 |

What is claimed is:

1. An underreamer, comprising:

a hollow body, with a longitudinal axis, the hollow body having an external wall and being arranged so that a pressurized drilling fluid can pass through the hollow body;

at least two cylindrical bores provided through the external wall, wherein respective axes of the cylindrical bores are transverse to the longitudinal axis;

in each of the bores, a cylindrical widening arm:

which has a cutting end provided with blades for widening a bore hole;

which can slide between an active position in which the cutting end is distant from the hollow body to effect a widening of the bore hole, and an inactive position in which the cutting end is at least close to, flush with, or retracted within an external periphery of the hollow body; and which has an internal end disposed inside the hollow body that is intended to receive from the pressurized drilling fluid a pressure capable of pushing the widening arm into the active position; and a locking member common to the widening arms:

which can occupy a locking position in which the locking member locks each of the widening arms in the inactive position;

which is immobilized in the hollow body, in a releasable manner, in the locking position, before use of the underreamer; and which can leave the locking position under a thrust of at least one of the widening arms subjected to the pressure if the pressure is capable of pushing the at least one of the widening arm into the active position.

2. The underreamer according to claim 1, wherein the locking member is fixed to the hollow body, in the said releasable manner, by a breakable pin calibrated for this purpose in accordance with a given pressure threshold of the fluid.

3. The underreamer according to claim 2, wherein the hollow body has, for receiving the breakable pin, a housing opening on the external periphery of the hollow body.

4. The underreamer according to claim 1, wherein the locking member is arranged to slide axially in the hollow body, from the locking position, under the thrust of the arms, and includes an end face which cooperates with a respective support face of each widening arm for locking of the widening arm.

5. The underreamer according to claim 4, wherein the respective axes of the cylindrical bores are, starting from the longitudinal axis, either perpendicular to the longitudinal axis or inclined in a direction of a drill string fixed upstream of the underreamer, and wherein the locking member is situated upstream of the widening arms, and slides upstream in order to release the widening arms.

6. The underreamer according to claim 1, further comprising a common prestressed spring system arranged to return the widening arms to the inactive position when the pressure of the fluid is below a given value.

7. The underreamer according to claim 6, wherein the spring system acts on the arms by means of the locking member in order to return the widening arms to the inactive position.

8. The underreamer according to claim 7, further comprising a removable stop, arranged so as to temporarily keep the spring system away from the arms, by means of the locking member.

9. The underreamer according to claim 6, further comprising a tool arranged to bear on the body and to move the spring system away from the arms, by means of and with the locking member.

10. The underreamer according to claim 1, wherein each of the bores is formed in a sleeve made from high-strength metal, adhesively bonded in a housing formed in the hollow body.

11. The underreamer according to claim 1, further comprising, downstream of the widening arms, a valve seat intended to receive a ball, launched via a drill string, in order to reduce, at a chosen moment, a cross-section of flow available for the drilling fluid and thus to increase a pressure of the drilling fluid on the widening arms, to hold the widening arms in the active position.

12. An underreamer, comprising;

an elongate, generally cylindrical body defining a longitudinal bore at least partially therethrough, and at least first and second peripheral bores extending generally from the longitudinal bore to an external surface of the body;

at least first and second cutting arms being disposed at least partially within the first and second peripheral bores, respectively;

each cutting arm being extendible from a first position in which the cutting arm is generally flush or recessed with respect to the external surface, to a second position in which the cutting arm is extended with respect to the external surface;

a locking member disposed within the hollow body, the locking member having a locked position in which the locking member maintains the cutting arms in the first position, and an unlocked position in which the locking member allows the cutting arm to extend to the second position; and wherein fluid pressure in the longitudinal bore, greater than a threshold pressure, acting upon at least one of the cutting arms causes the at least one of the cutting arms to force the locking member from the locked position to the unlocked position.

13. The underreamer of claim 12, wherein the at least first and second cutting arms comprise first, second and third cutting arms, and wherein each cutting arm may extend and retract, with respect to the cylindrical body, independently of the other cutting arms, when the locking member is in the unlocked position.

14. The underreamer of claim 12, wherein the generally cylindrical body is oriented around a longitudinal axis, and the first and second peripheral bores are oriented around first and seconds axes that are transverse to the longitudinal axis, the underreamer further comprising:

an internal piece removably fixed in the hollow body, downstream of the arms; and the internal piece including at least one guidance groove facing the first and second cutting arms for preventing rotation of the first and second cutting arms about the first and second axes, respectively, the groove having two generally parallel sides extending generally parallel to the longitudinal axis, the sides being arranged so as to cooperate with two generally parallel edges carried by each of the first and second cutting arms, wherein the groove has a length, width and depth corresponding to the edges and a path made by the edges between the active and inactive positions of the first and second cutting arms.

15. The underreamer of claim 14, wherein each of the first and second cutting arms further comprise a lug extending downstream and generally parallel to the longitudinal axis of the body, wherein each lug includes the two generally parallel edges carried by each of the first and second cutting arms.

16. The underreamer of claim 12, wherein each of the bores is fashioned in a sleeve made from high-strength metal, the sleeve being adhesively bonded in a housing formed in the cylindrical body.

17. The underreamer of claim 12, further comprising a valve seat downstream of the first and second cutting arms, configured to receive a ball, wherein a cross-section of flow available for a fluid is selectively reduced by setting the ball at least partially in the valve seat, to increase the pressure of the fluid on the first and second cutting arms, so that the first and second cutting arms are maintained in the active position.

18. The underreamer of claim 12, further comprising a breakable pin forming a releasable coupling between the cylindrical body and the locking member, and wherein the breakable pin is calibrated such that it will fracture and release the releasable coupling when exposed to a threshold amount of force.

19. The underreamer of claim 18, wherein an external portion of the body defines a cavity configured to receive the breakable pin and allows for installation of the breakable pin from the external portion of the body.

20. The underreamer of claim 12, further comprising an electrical activator, wherein the activator comprises a control tube operable to occupy a first position proximate to the locking member for immobilising the locking member in the locking position, and a second position retracted from the locking member for enabling the locking member to allow the first and second cutting arms to move to the active position.

21. The underreamer of claim 12, wherein the locking member further includes an end face operable to engage a support face of each of the first and second cutting arms, wherein engagement of the end face and each support face is operable to retain each of the first and second cutting arms in the inactive position.

22. The underreamer of claim 21, wherein the locking member is arranged to slide axially in the cylindrical body when forced from the locking position.

23. An underreamer for a bore hole in a terrestrial formation, the underreamer comprising:

a housing defining a hollow body and at least first and second bores in fluid communication with the hollow body, wherein the hollow body is operable to receive a pressurized drilling fluid;

first and second cutting arms disposed in the first and second bores, respectively, and operable to slide in their respective bore from an inactive position to an active position when actuated by the pressurized drilling fluid, wherein the first and second cutting arms are sized relative to an inside diameter of the hollow body so that the first and second cutting arms can be installed in their respective bores from the interior of the hollow body;

upstream and downstream ends of the hollow body, wherein the upstream end has external threads of a first diameter, and the downstream end has a threaded hole with a second diameter greater than the first diameter; and an adaptation piece screwed into the threaded hole, wherein the adaptation piece includes a male thread fitting the threaded hole and a female thread fitting the external threads.

24. The underreamer of claim 23, wherein an axial length and shape of the first and second cutting arms further enable the first and second cutting arms to be installed from the interior of the hollow body.

25. The underreamer of claim 24, wherein the second diameter is sized for attaching directly to a drill bit.

26. An underreamer for a bore hole in a terrestrial formation, the underreamer comprising:

a housing defining a hollow body and at least first and second bores in fluid communication with the hollow body, wherein the hollow body is operable to receive a pressurized drilling fluid;

first and second cutting arms disposed in the first and second bores, respectively, each cutting arm having a protrusion arranged at an internal end accessible to the fluid;

a locking member operable to engage the first and second cutting arms wherein the locking member maintains the first and second cutting arms in the inactive position until the locking member is released; and wherein the first and second cutting arms are operable to slide in their respective bore from an inactive position to an active position when actuated by the fluid, and wherein the protrusion of each cutting arm is arranged to inhibit a flow of the fluid in the hollow body when the cutting arms are in the inactive position and to not inhibit the flow of the fluid when the first and second cutting arms are in the active position, so that a detectable difference in fluid pressure is produced between the active and inactive positions.

27. The underreamer of claim 26, wherein the locking member is forced from the locking position after being released by the actuation of at least one of the first or second cutting arms by the fluid.

* * * * *

UNITED STATES PATENT AND TRADEMARK OFFICE

CERTIFICATE OF CORRECTION

PATENT NO. : 6,886,633 B2
DATED : May 3, 2005
INVENTOR(S) : Fanuel et al.

It is certified that error appears in the above-identified patent and that said Letters Patent is hereby corrected as shown below:

Title page,
Item [75], Inventors, delete "Philipp Fanuel" and replace with -- Philippe Fanuel --.

Signed and Sealed this

Thirteenth Day of September, 2005

JON W. DUDAS
*Director of the United States Patent and Trademark Office*